US012275554B1

(12) United States Patent
Blumenthal

(10) Patent No.: US 12,275,554 B1
(45) Date of Patent: Apr. 15, 2025

(54) COLLAPSIBLE, LID-ATTACHED, FOOD-SAFE STORAGE CONTAINER

(71) Applicant: Kevin Blumenthal, Washington, DC (US)

(72) Inventor: Kevin Blumenthal, Washington, DC (US)

( * ) Notice: Subject to any disclaimer, the term of this patent is extended or adjusted under 35 U.S.C. 154(b) by 74 days.

(21) Appl. No.: 18/479,217

(22) Filed: Oct. 2, 2023

(51) Int. Cl.
*B65D 6/18* (2006.01)
*B65D 6/00* (2006.01)
*B65D 25/54* (2006.01)

(52) U.S. Cl.
CPC ..... *B65D 11/1833* (2013.01); *B65D 11/20* (2013.01); *B65D 25/54* (2013.01)

(58) Field of Classification Search
CPC .... B65D 11/1833; B65D 25/54; B65D 11/20; B65D 7/26
USPC ..... 220/6, 7, 4.28
See application file for complete search history.

(56) References Cited

U.S. PATENT DOCUMENTS

| | | | |
|---|---|---|---|
| 752,880 | A * | 2/1904 | Bacon |
| 2,649,238 | A | 8/1953 | Brooks |
| 3,330,437 | A | 7/1967 | Bellamy |
| 4,002,287 | A | 1/1977 | Saveth |
| 8,167,157 | B2 | 5/2012 | Shalomoff |

* cited by examiner

*Primary Examiner* — Stephen J Castellano
(74) *Attorney, Agent, or Firm* — Carter, DeLuca & Farrell LLP

(57) ABSTRACT

A collapsible, lid-attached, food-safe storage container includes six panels and is selectively collapsible between an assembled configuration, in which the container is arranged as a rectangular cuboid having a fluid- and/or air-tight hollow interior space delimited by the six panels, and a collapsed configuration, in which the six panels are stacked on top of each other.

22 Claims, 14 Drawing Sheets

COLLAPSIBLE, LID-ATTACHED, FOOD-SAFE STORAGE CONTAINER

FIELD OF THE INVENTION

The present application relates to a collapsible, lid-attached, food-safe storage container.

BACKGROUND INFORMATION

Food storage containers are convenient for storing food items in a pantry, refrigerator, freezer, etc. Such containers are available in a variety of sizes and shapes. However, conventional storage containers are bulky and require substantial space for storage. Additionally, since there are numerous sizes and shapes of food storage containers, it is difficult to efficiently store and/or stack such containers in kitchen cabinets, etc., leading to clutter and disorganized kitchen cabinets. Moreover, conventional storage containers typically have separate lids and bases, such that it is common to lose, misplace, or mismatch the lids and bases.

Therefore, there is believed to be a need for a collapsible, lid-attached, food-safe storage container.

SUMMARY

Example embodiments of the present invention provide collapsible, lid-attached, e.g., integral/unitary, food-safe storage container that includes: a rectangular planar bottom panel having first and second long sides having a length and first and second short sides having a width; a rectangular planar top panel having first and second long sides having substantially the same length as the long sides of the bottom panel and first and second short sides having substantially the same width as the short sides of the bottom panel; a rectangular planar rear panel having first and second long sides having substantially the same length as the long sides of the bottom panel and first and second short sides having substantially the same width as the short sides of the bottom panel; a rectangular planar front panel having first and second long sides having substantially the same length as the long sides of the bottom panel and first and second short sides having substantially the same width as short sides of the bottom panel; a first square planar side panel having four sides having substantially the same length as the short sides of the bottom panel; and a second square planar side panel having four sides having substantially the same length as the short sides of the bottom panel. The second long side of the top panel is integrally connected to the first long side of the rear panel by a first living hinge, the second long side of the rear panel is integrally connected to the first long side of the bottom panel by a second living hinge, the second long side of the bottom panel is integrally connected to the first long side of the front panel by a third living hinge, the first short side of the bottom panel is integrally connected to a first side of the first side panel by a fourth living hinge, and the second short side of the bottom panel is integrally connected to a first side of the second side panel by a fifth living hinge. The container is selectively collapsible between an assembled configuration and a collapsed configuration. In the assembled configuration, the container is arranged as a rectangular cuboid having a fluid- and/or air-tight hollow interior space delimited by the front panel arranged opposite and facing the rear panel. Additionally, in the assembled configuration, the first side panel is arranged opposite and facing the second side panel, and the top panel is arranged opposite and facing the bottom panel. Moreover, in the assembled configuration, the first short side of the rear panel is secured to a third side of the first side panel by a first detachable latch mechanism, the second short side of the rear panel is secured to a third side of the second side panel by a second detachable latch mechanism, the first short side of the front panel is secured to a fourth side of the first side panel, opposite the third side of the first side panel, by a third detachable latch mechanism, the second short side of the front panel is secured to a fourth side of the second side panel, opposite the third side of the second side panel, by a fourth detachable latch mechanism, and the first long side of the top panel is secured to the second long side of the front panel, opposite the first long side of the front panel, by a fifth detachable latch mechanism. In the assembled configuration, the top panel is pivotable about the first living hinge to selectively open and close the container to access the interior space. In the assembled configuration, each panel has a respective first face facing the hollow interior space and a respective second face facing an exterior of the container. In the collapsed configuration, the panels are stacked, the second face of the top panel arranged in abutting opposition to the second face of the rear panel, the first face of the rear panel arranged in abutting opposition to the first face of the bottom panel, the second face of each side panel arranged in abutting opposition to the second face of the bottom panel, the second face of the front panel arranged in abutting opposition to the first face of each side panel. The length of the bottom panel is at least twice the length of the side panels, and the container is formed of a food-safe material.

According to example embodiments, the material includes a food-grade plastic.

According to example embodiments, the material includes high-density polyethylene (HDPE plastic), low-density polyethylene (LDPE plastic), polyethylene terephthalate (PET/PETE), food-grade polypropylene (PP), polycarbonate (PC), acrylic, and/or nylon.

According to example embodiments, the material is biodegradable, recyclable, and/or eco-friendly.

According to example embodiments, the material is translucent.

According to example embodiments, the material is colorless or colored, e.g., tinted.

According to example embodiments, each latch mechanism includes an elongated protrusion arranged on a first mating surface of a first one of the panels that is insertable into a corresponding elongated groove arranged on a second mating surface of a second one of the panels.

According to example embodiments, the elongated protrusion extends substantially along an entire length of the first mating surface, and the elongated groove extends substantially along an entire length of the second mating surface.

According to example embodiments, the protrusion and the groove form an interference fit.

According to example embodiments, a front edge of the top panel includes an elongated groove or indentation arranged as an elongated finger pull.

According to example embodiments, each mating surface of each of the panels is beveled.

According to example embodiments, each mating surface of at least one pair of adjacent panels is beveled.

According to example embodiments, each mating surface of each of the panels is orthogonal.

According to example embodiments, each mating surface of at least one pair of adjacent panels is orthogonal.

According to example embodiments, each mating surface at each living hinge is beveled, and each mating surface at each latching mechanism is orthogonal.

According to example embodiments, each pair of mating surfaces of the panels includes a seal.

According to example embodiments, the seal includes an O-ring and/or a lip seal.

According to example embodiments, the material includes a dishwasher-safe material.

According to example embodiments, the material includes a microwave-safe material.

According to example embodiments, a thickness of the top panel, the bottom panel, the first and second side panels, the front panel, and the rear panel are substantially equal.

According to example embodiments, the groove or indentation, e.g., the finger pull, extends substantially along the entire length of the front edge of the top panel.

Further features and aspects of example embodiments of the present invention are described in more detail below with reference to the appended schematic Figures.

DETAILED DESCRIPTION

Figure 1:
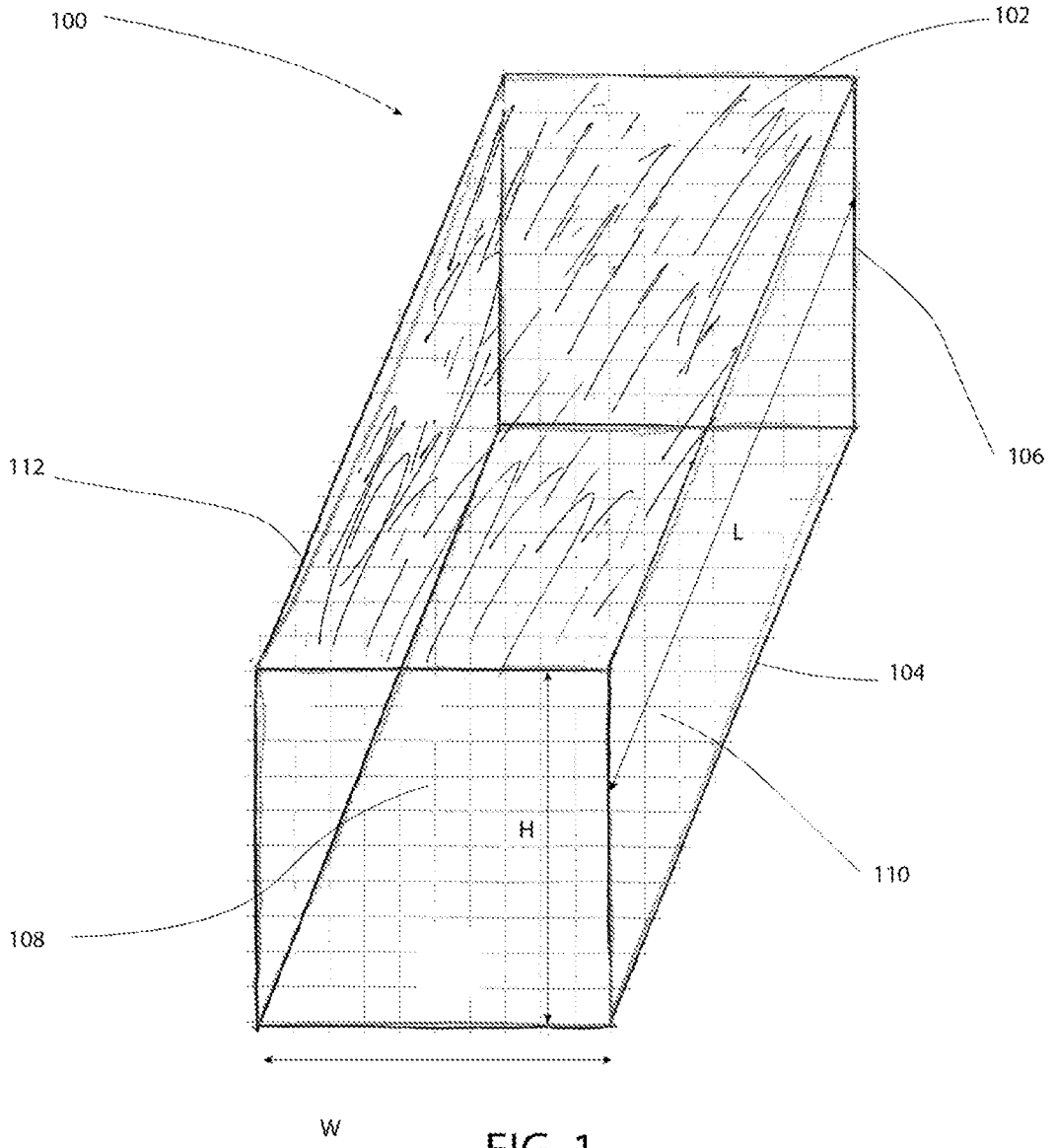
FIG. 1 is a perspective view of a collapsible, lid-attached, food-safe storage container in an assembled configuration and with a top panel of the container in a closed position.

FIG. 1 is a perspective view of a collapsible, or foldable, lid-attached, e.g., integral/unitary, food-safe storage container 100 in an assembled configuration and with a top panel 102 of the container in a closed position. In the assembled configuration, the container 100 forms a rectangular cuboid (also referred to as a right rectangular prism, rectangular parallelepiped, or orthogonal parallelepiped). As illustrated in FIG. 1, for example, the container 100 includes, in addition to the top panel 102, a bottom panel, 104, first and second side panels 106, 108 that are arranged opposite each other, a front panel 112, and a rear panel 110, to form a hollow interior 114 of the container. The hollow interior 114 is adapted to receive item(s) for storage, such as food items, and, in the assembled configuration of container 100, the hollow interior 114 is liquid- and/or air-tight, to increase the shelf life of food items stored in container 100 and to prevent leakage of the contents contained in the hollow interior 114 of container 100. The container 100 is formed of a food-safe material, such as a food-grade plastic, e.g., high-density polyethylene (HDPE plastic), low-density polyethylene (LDPE plastic), polyethylene terephthalate (PET/PETE), food-grade polypropylene (PP), polycarbonate (PC), acrylic, nylon, etc. The container 100 is formed of a dishwasher-safe material, so that the container 100 may be cleaned utilizing a standard dishwasher without causing any damage. The container 100 is formed of a microwave-safe material, so that the container 100 may be utilized in a microwave oven to heat or re-heat the contents of the container without causing any damage and without risk to the contents of the container 100. The material of the container 100 may be bio-degradable, recyclable, eco-friendly, etc. It should be appreciated that container 100 may be formed of other material(s), including non-food-safe material(s), for storage of items other than food items. Additionally, the container 100 may be formed of a translucent and/or transparent material, so that the content(s) of the container 100 are discernable without opening the container 100, although, the material of the container 100 may be opaque. The material of the container 100 may be colorless, colored, tinted, etc.

Figure 2:
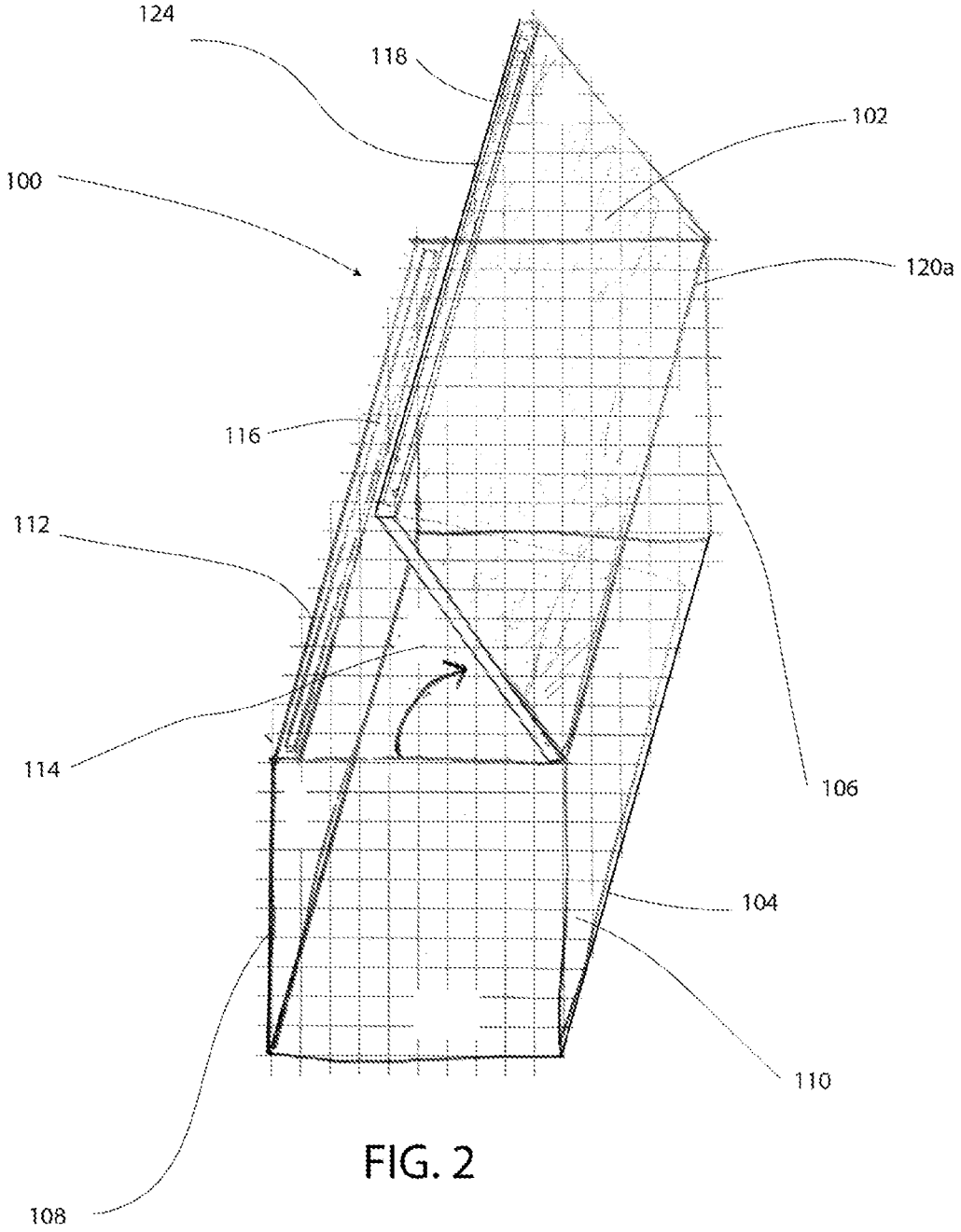
FIG. 2 is a perspective view of the container in the assembled configuration and with the top panel of the container in an open position.

FIG. 2 is a perspective view of the container 100 in the assembled configuration and with the top panel 102 of the container in an open position, allowing access to the interior 114. Top panel 102 is connected to the rear panel 110 by a living hinge 120*a*, also referred to as an integral hinge. so that the top panel 102 may be selectively moved between its open position, e.g., illustrated in FIG. 2, and its closed position, e.g., illustrated in FIG. 1. The top edge of the front panel 112 includes an elongated groove 116 extending substantially the entire length of the top edge of the front panel 112, and the bottom surface of the top panel 102 includes a protrusion 118 extending substantially the entire length of the bottom surface. The protrusion 118 is substantially the same length as the groove 116. The protrusion 118 is insertable into the groove 116 so that, when the8ontainner 100 is in the closed configuration, the engagement of the protrusion 118 into groove 116 secures the top panel 102 in its closed position. The groove 116 may be slightly smaller in length and width than the protrusion 118 so that the protrusion 118 has an interference or transition fit with the groove 116, the friction of the fit maintaining the engagement of the protrusion 118 and groove 116. The elasticity material of the container 100 may further enhance the frictional engagement between protrusion 118 and groove 116. The fit between protrusion 118 and groove 116 may be determined or calculated utilizing industry standard calculations, e.g., according to ISO 286.

Figure 3:
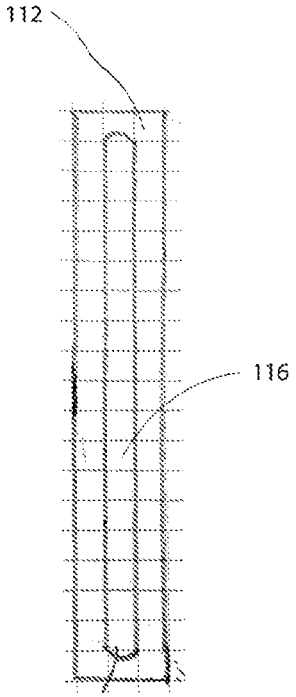
FIG. 3 is a top view of a front side panel of the container.
Figure 4:
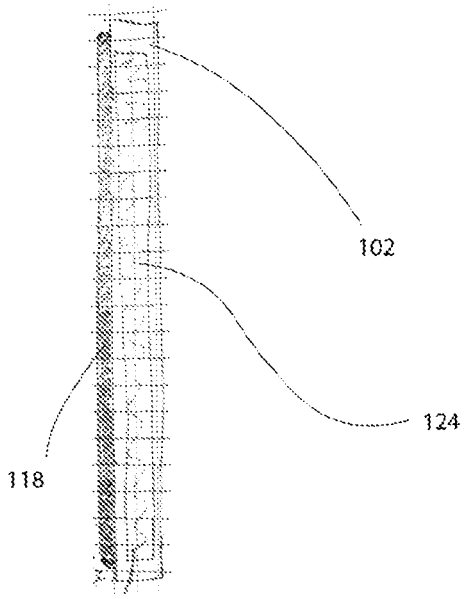
FIG. 4 is an end view of the top panel of the container.

FIG. 3 is a top view of the front side panel 112 of the container 100, illustrating the groove 116, and FIG. 4 is an end view of the top panel 102 of the container 100, illustrating the protrusion 118 that is insertable into the groove 116 and also illustrating an elongated indentation 124 on the end face of the top panel 102. The indentation 124 extends substantially along the entire length of the end face of the top panel 102 and is arranged as a finger pull to facilitate opening of the container 100.

Figure 5:
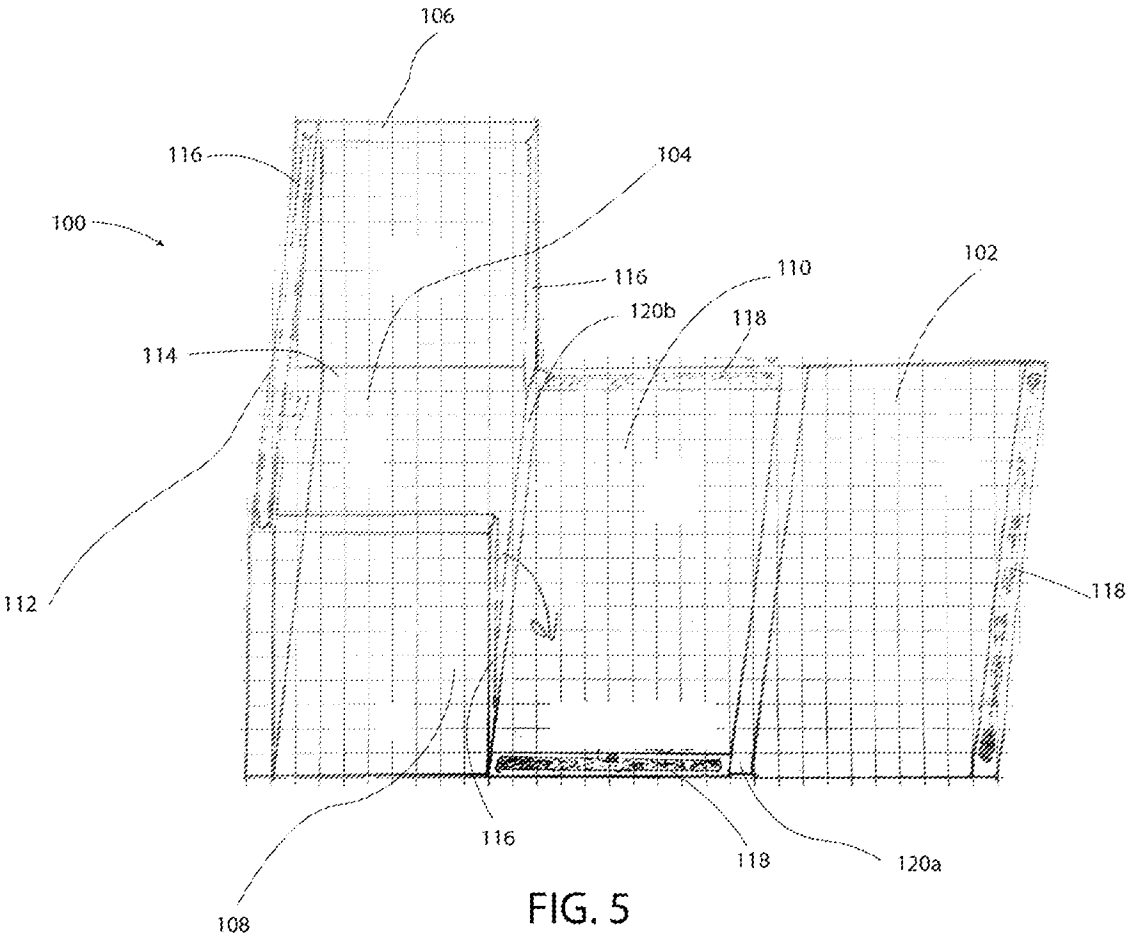
FIG. 5 is a perspective view of the container in a partially collapsed configuration.

FIG. 5 is a perspective view of the container in a partially collapsed configuration. In the partially collapsed configuration illustrated in FIG. 5, the bottom panel 104, top panel 102, and rear panel 110 lay substantially flat, e.g., bottom panel 104, top panel 102, and rear panel 110 are substantial coplanar. As illustrated in FIG. 5, rear panel 110 is connected to bottom panel 104 by living hinge 120*b*. Each side of the rear panel 110 that faces the interior 114 of the container 100 in the assembled state includes a protrusion 118, and the end face of the side panel 106, 108 that faces the rear panel 110 of the container 100 in the assembled state includes a groove 116, adapted to receive the respective protrusion 118. Analogous to the groove 116 of the front panel 112 and protrusion 118 of top panel 102, protrusions 118 of rear panel 110 and groove 116 of each side panel 106, 108 form an interference or friction fit, to maintain the container 100 in the assembled configuration, and are selectively engaged and disengaged to assemble or collapse the container 100.

Figure 6:
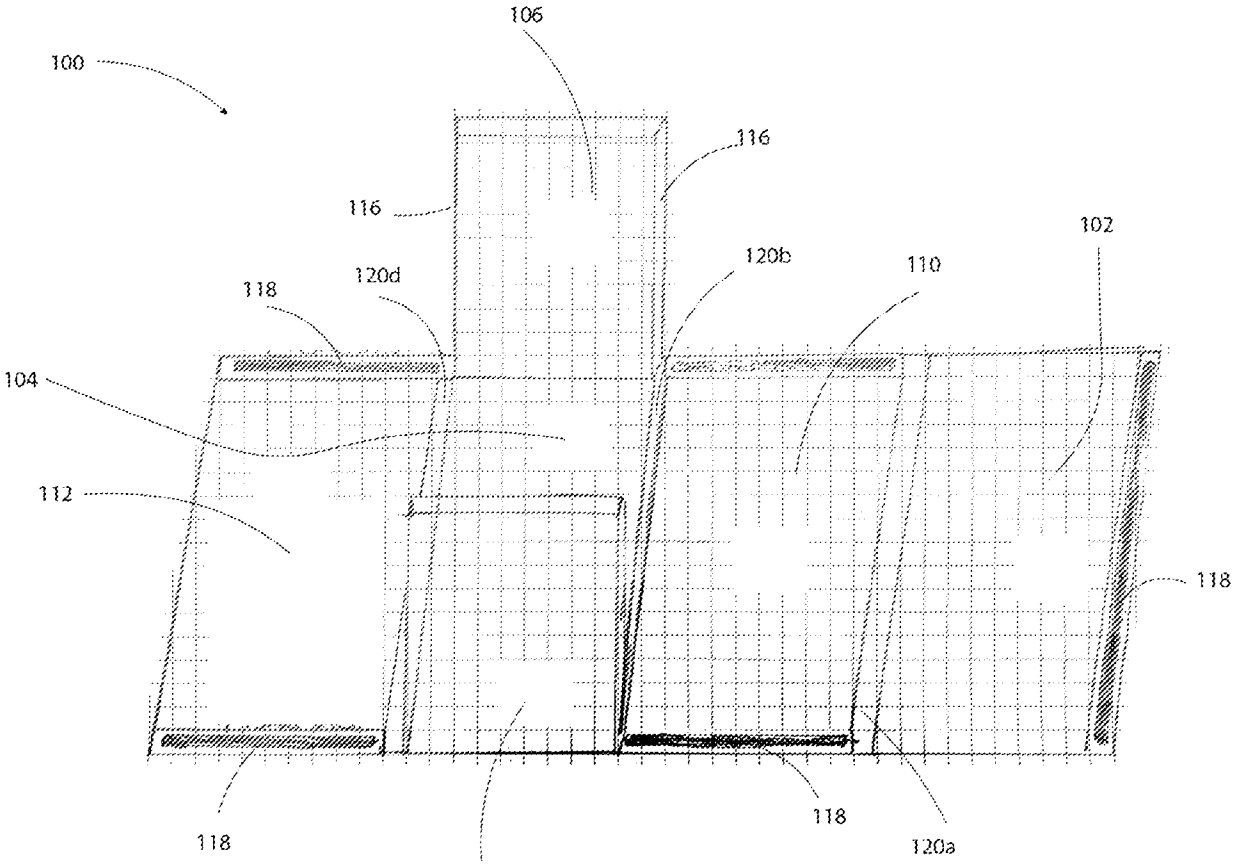
FIG. 6 is a perspective view of the container in a further partially collapsed configuration.

FIG. 6 is a perspective view of the container 100 in a further partially collapsed configuration. In the partially collapsed configuration illustrated in FIG. 6, the bottom panel 104, top panel 102, rear panel 110, and front panel 112 lay substantially flat, e.g., bottom panel 104, top panel 102, rear panel 110, and front panel 112 are substantial coplanar. As illustrated in FIG. 6, front panel 112 is connected to bottom panel 104 by living hinge 120*d*. Each side of the front panel 112 that faces the interior 114 of the container 100 in the assembled state includes a protrusion 118, and the end face of the side panel 106, 108 that faces the front panel 112 of the container 100 in the assembled state includes a groove 116, adapted to receive the respective protrusion 118. Analogous to the groove 116 of the front panel 112 and protrusion 118 of top panel 102, protrusions 118 of front panel 112 and groove 116 of each side panel 106, 108 form an interference or friction fit, to maintain the container 100 in the assembled configuration, and are selectively engaged and disengaged to assemble or collapse the container 100.

Figure 7:
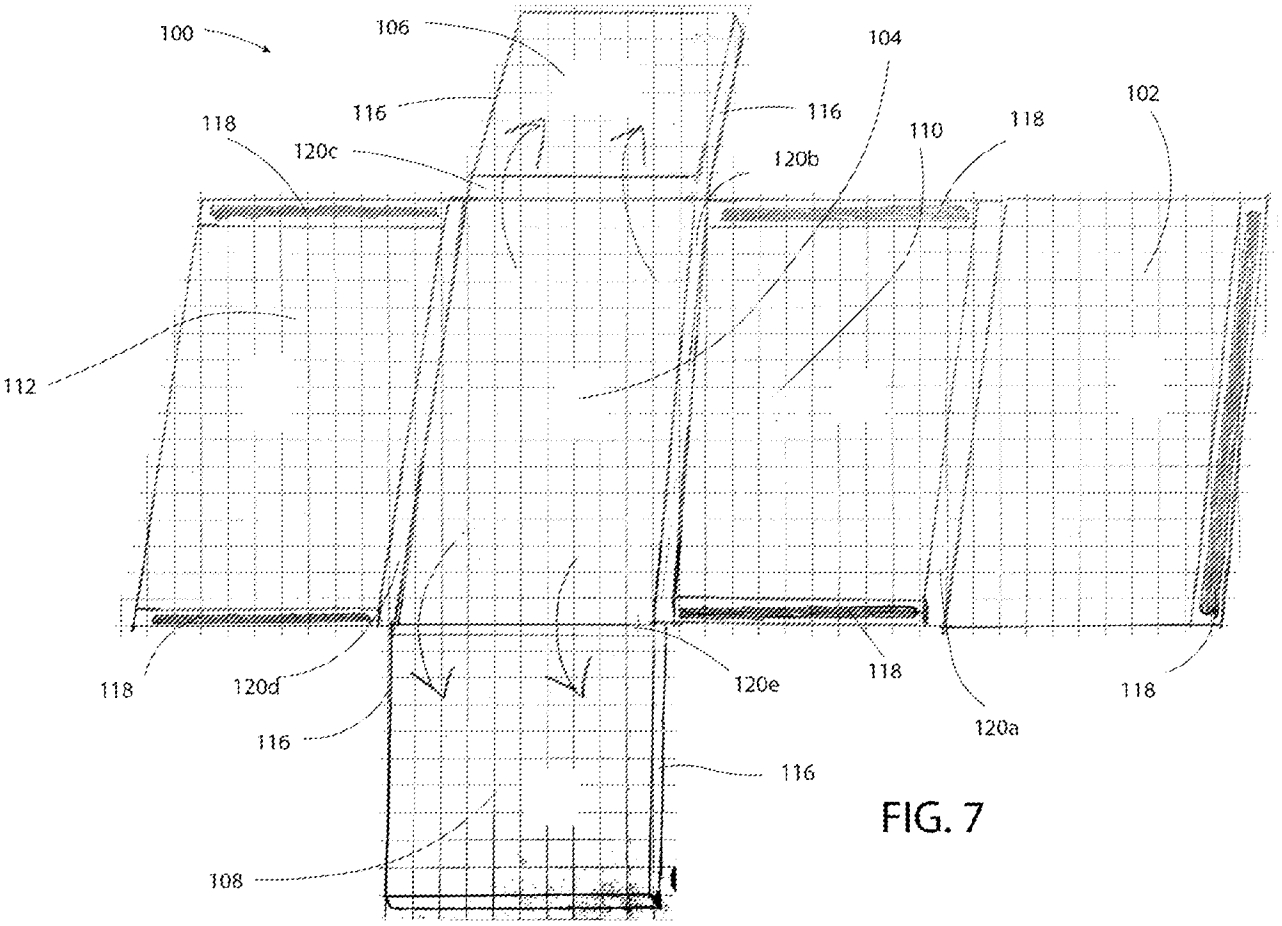
FIG. 7 is a perspective view of the container in a further partially collapsed configuration.

FIG. 7 is a perspective view of the container 100 in a further partially collapsed configuration. In the partially collapsed configuration illustrated in FIG. 7, the bottom panel 104, top panel 102, rear panel 110, front panel 112, side panel 106, and side panel 108 lay substantially flat, e.g., bottom panel 104, top panel 102, rear panel 110, front panel 112, side panel 106, and side panel 108 are substantial coplanar. As illustrated in FIG. 7, side panel 106 is connected to bottom panel 104 by living hinge 120*c*, and side panel 108 is connected to bottom panel 104 by living hinge 120*e*.

While protrusions 118 are described above as being provided on top panel 102, rear panel 110, and front panel 112 and grooves are described above as being provided on front panel 112, side panel 106, and side panel 108, it should be appreciated that any, or all, respective pairs of protrusions 118 and grooves 116 may be reversed. It should be further appreciated that other mechanism(s) may be provided to secure container 100 in the assembled configuration, to provide for selective assembly and collapse of the container, to secure top panel 102 in the closed position, and to provide for selective opening and closing of the top panel 102. The mating surfaces of the container 100 may be beveled, may be orthogonal, etc.

Figure 8:
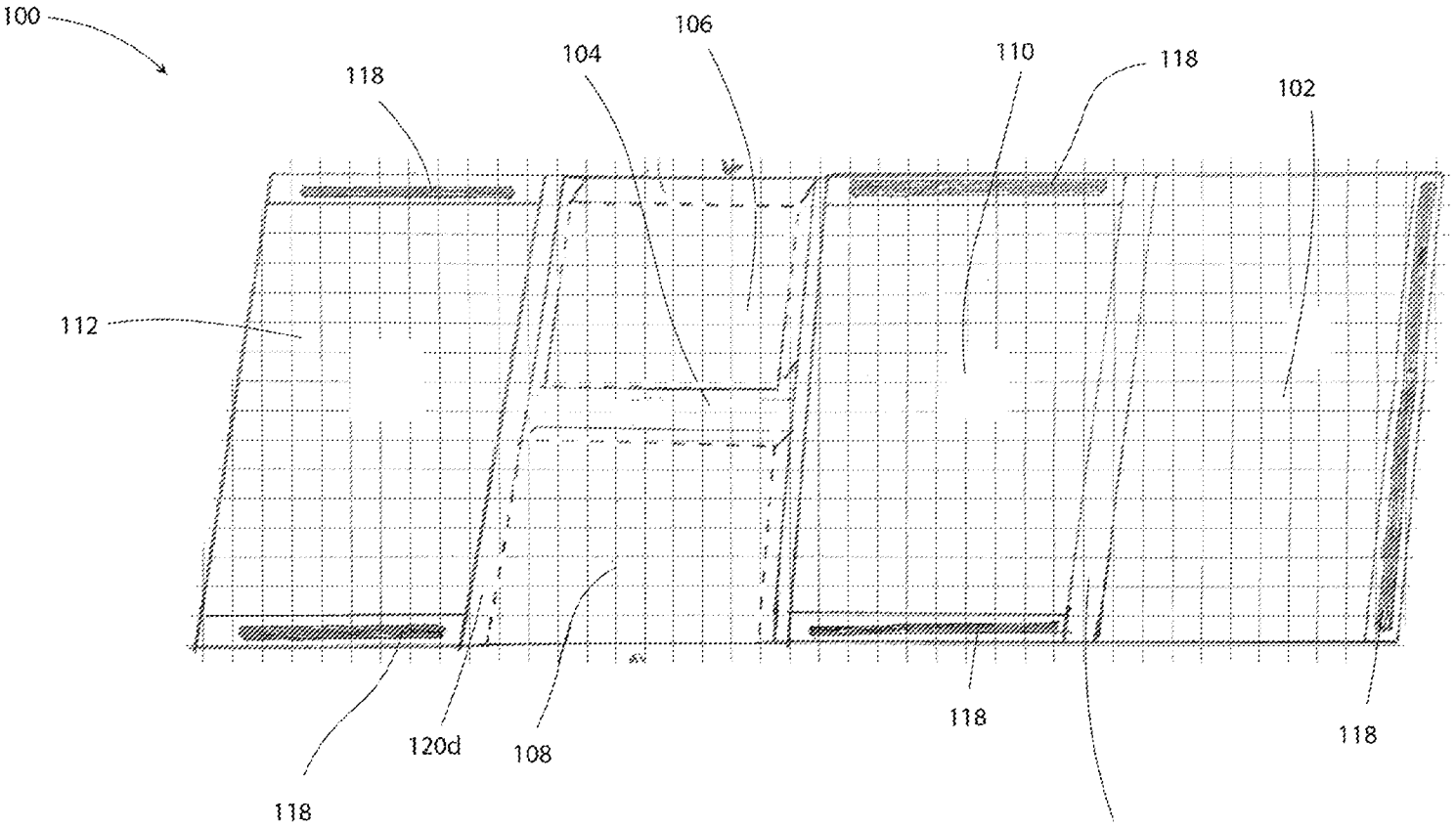
FIG. 8 is a perspective view of the container in a further partially collapsed configuration.
Figure 9:
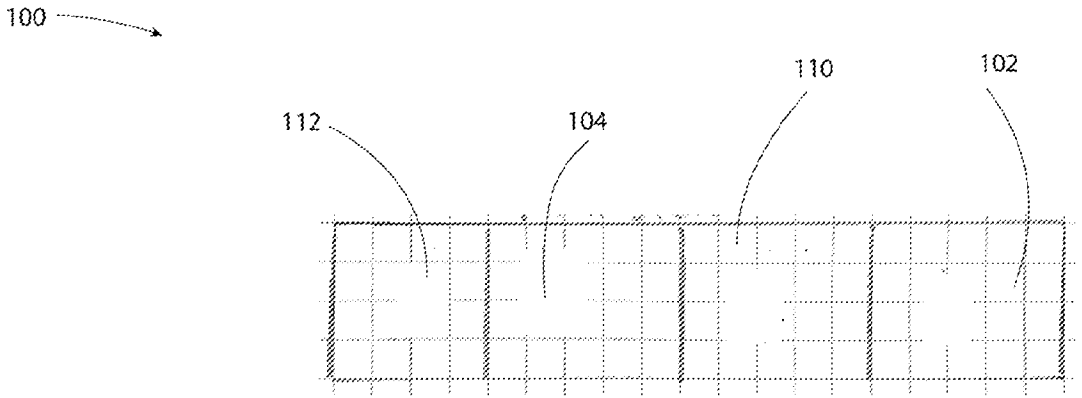
FIG. 9 is a top view of the container in the partially collapsed configuration illustrated in FIG. 8.
Figure 10:
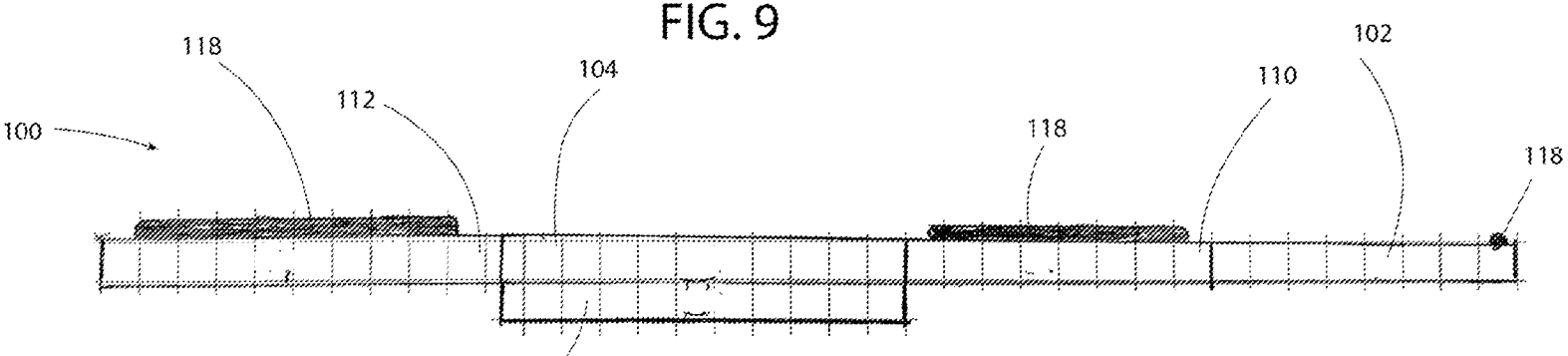
FIG. 10 is a side view of the container in the partially collapsed configuration illustrated in FIGS. 8 and 9.

FIG. 8 is a perspective view of the container 100 in a further partially collapsed configuration, FIG. 9 is a top view of the container 100 in the partially collapsed configuration illustrated in FIG. 8, and FIG. 10 is a side view of the container 100 in the partially collapsed configuration illustrated in FIGS. 8 and 9. In the partially collapsed configuration illustrated in FIGS. 8 to 10, the bottom panel 104, top panel 102, rear panel 110, and front panel 112 lay substantially flat, e.g., bottom panel 104, top panel 102, rear panel 110, front panel 112 are substantial coplanar, and side panel 106 and side panel 108 are folded under bottom panel 104.

Figure 11:
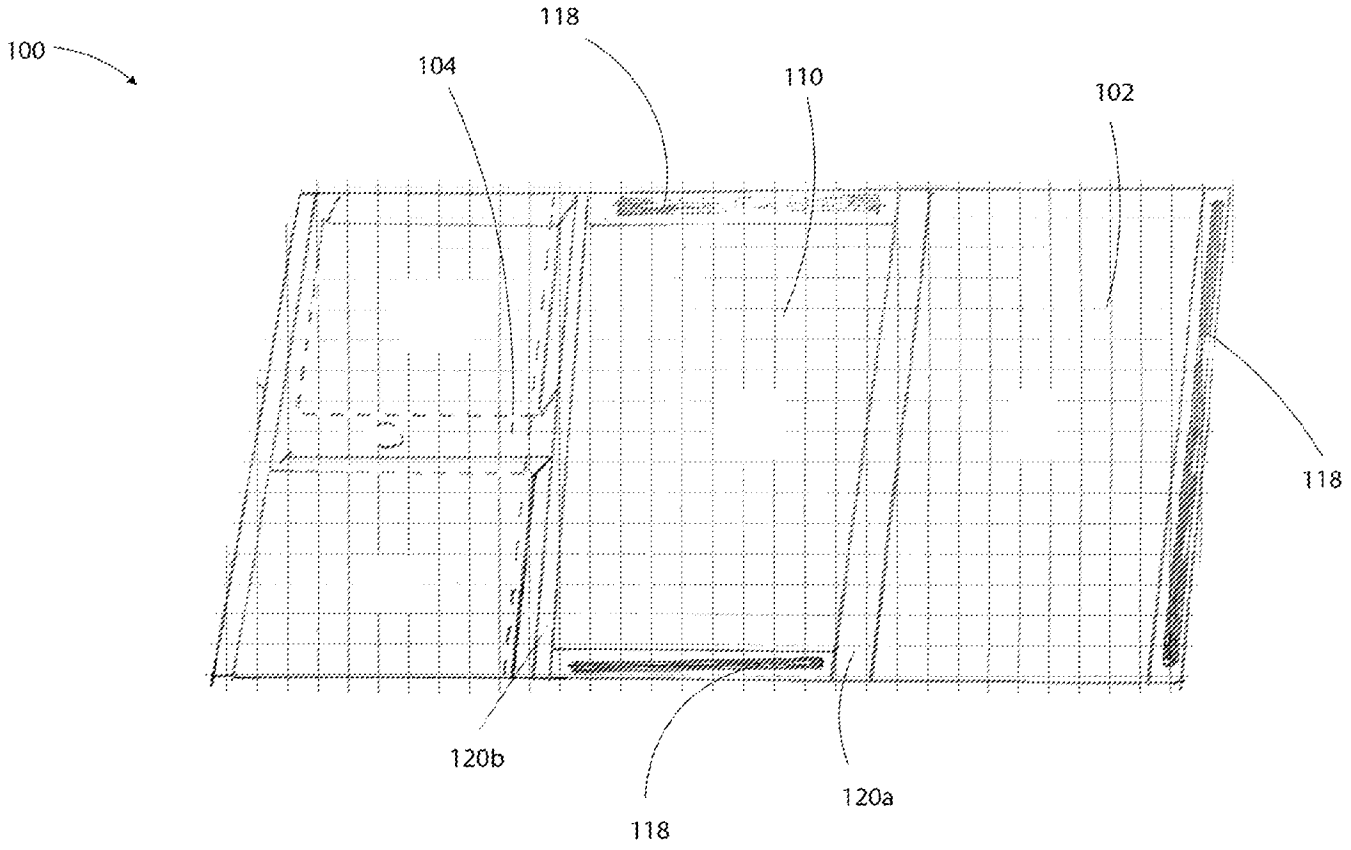
FIG. 11 is a perspective view of the container in a further partially collapsed configuration.
Figure 12:
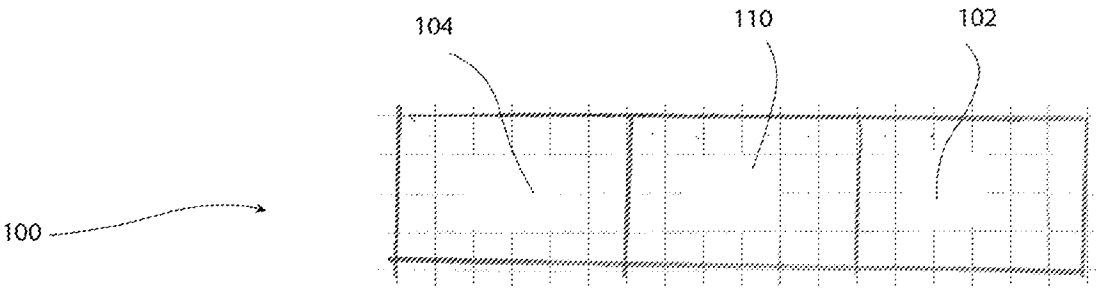
FIG. 12 is a top view of the container in the partially collapsed configuration illustrated in FIG. 11.
Figure 13:
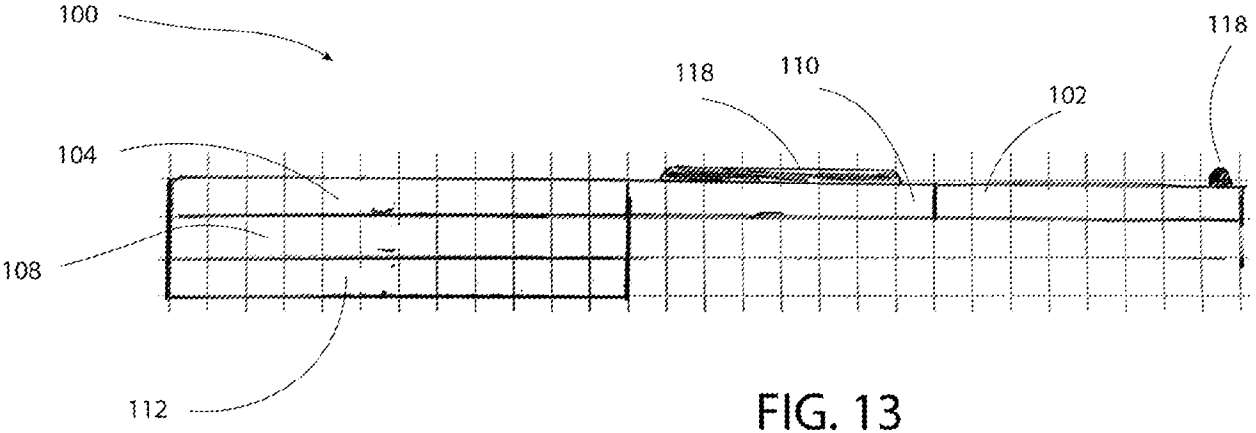
FIG. 13 is a side view of the container in the partially collapsed configuration illustrated in FIGS. 11 and 12.

FIG. 11 is a perspective view of the container 100 in a further partially collapsed configuration, FIG. 12 is a top view of the container 100 in the partially collapsed configuration illustrated in FIG. 11, and FIG. 13 is a side view of the container 100 in the partially collapsed configuration illustrated in FIGS. 11 and 12. In the partially collapsed configuration illustrated in FIGS. 11 to 13, the bottom panel 104, top panel 102, and rear panel 110 lay substantially flat, e.g., bottom panel 104, top panel 102, and rear panel 110 are substantially coplanar, side panel 106 and side panel 108 remain folded under bottom panel 104, and front panel 112 is folded under side panel 106 and side panel 108.

Figure 15:
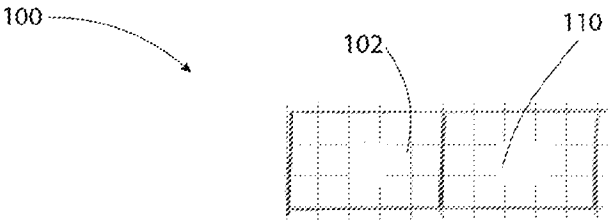
FIG. 15 is a top view of the container in the partially collapsed configuration illustrated in FIG. 14.
Figure 14:
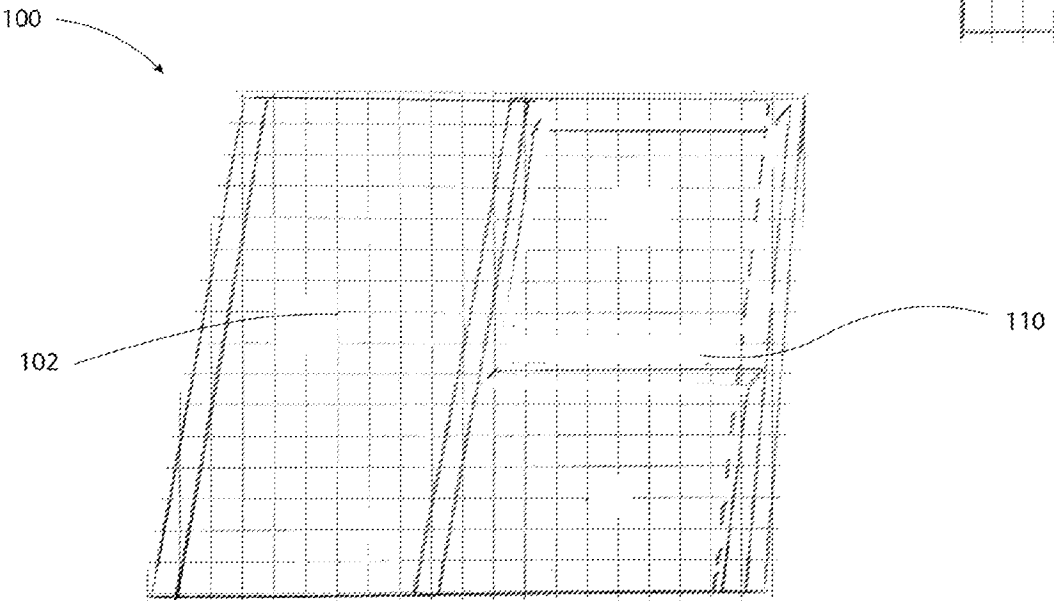
FIG. 14 is a perspective view of the container in a further partially collapsed configuration.
Figure 16:
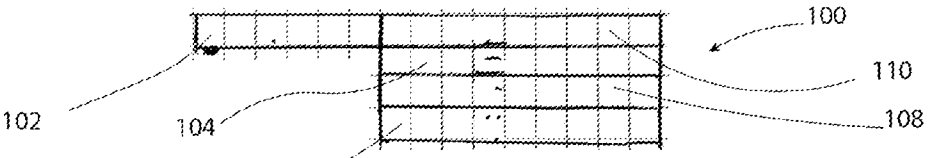
FIG. 16 is a side view of the container in the partially collapsed configuration illustrated in FIGS. 14 and 15.

FIG. 14 is a perspective view of the container 100 in a further partially collapsed configuration, FIG. 15 is a top view of the container 100 in the partially collapsed configuration illustrated in FIG. 14, and FIG. 16 is a side view of the container 100 in the partially collapsed configuration illustrated in FIGS. 14 and 15. In the partially collapsed configuration illustrated in FIGS. 14 to 16, the rear panel 110 is folded over bottom panel 104, side panel 106 and side panel 108 remain folded under bottom panel 104, and front panel 112 remains folded under side panel 106 and side panel 108.

Figure 18:
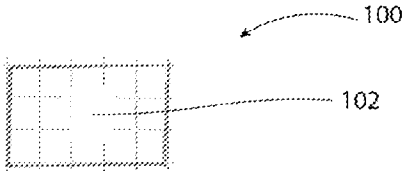
FIG. 18 is a top view of the container in the fully collapsed configuration illustrated in FIG. 17.
Figure 19:
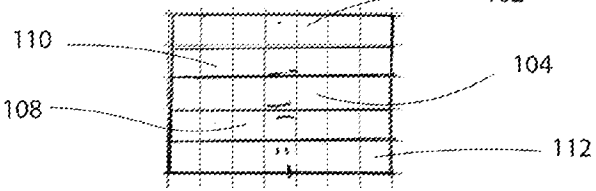
FIG. 19 is a side view of the container in the fully collapsed configuration illustrated in FIGS. 17 and 18.
Figure 17:
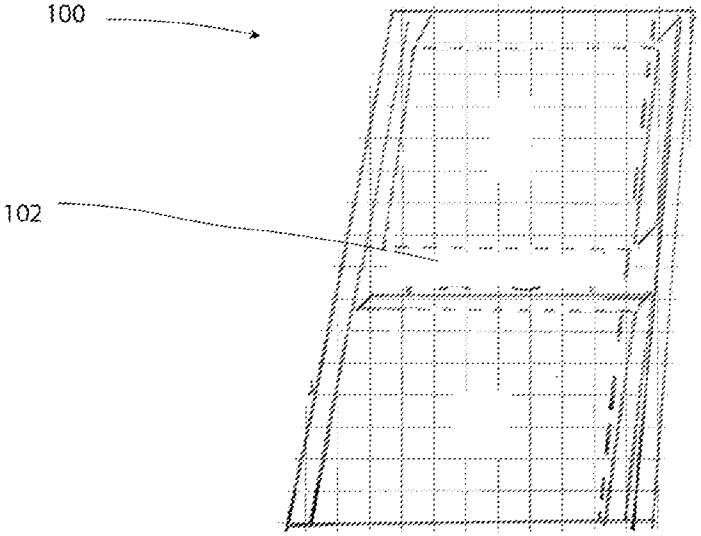
FIG. 17 is a perspective view of the container in a fully collapsed configuration.

FIG. 17 is a perspective view of the container 100 in a fully collapsed configuration, FIG. 18 is a top view of the container 100 in the fully collapsed configuration illustrated in FIG. 17, and FIG. 19 is a side view of the container 100 in the fully collapsed configuration illustrated in FIGS. 17 and 18. In the fully collapsed configuration illustrated in FIGS. 17 to 19, the top panel 102 is folded over rear panel 110, rear panel remains folded over bottom panel 104, side panel 106 and side panel 108 remain folded under bottom panel 104, and front panel 112 remains folded under side panel 106 and side panel 108. Thus, as illustrated in FIG. 18, in the fully collapsed configuration of container 100, the footprint, e.g., the length L and width W, of container 100 is substantially equal to that of the top panel 102 and/or bottom panel 104, and as illustrated in FIG. 19, in the fully collapsed configuration of container 100, the elevation, e.g., the height, is substantially equal to the sum of the thicknesses of (a) top panel 102, (b) bottom panel 104, (c) front panel 112, (d) rear panel 110, and (e) side panel 106 or 108.

It should be appreciated that the container 100 as described herein has a width W, a height H, and a length L, and that the length L may be at least or more than twice the height H so that in the partially, or fully, collapsed configuration of the container 100, the side panels 106, 108 are able to fold flat against the bottom panel 104 and the front panel 112 is able to fold flat against the side panels 106, 108. It should also be appreciated that the height H and width W are equal, e.g., the side panels 106, 108 being substantially square and the front panel 112, the bottom panel 104, the rear panel 110, and the top panel 102 having the same size as each other. In other words, the length of each of the front panel 112, the bottom panel 104, the rear panel 110, and the top panel 102 is the same and the width of each of the front panel 112, the bottom panel 104, the rear panel 110, and the top panel 102 is the same.

Figure 20:
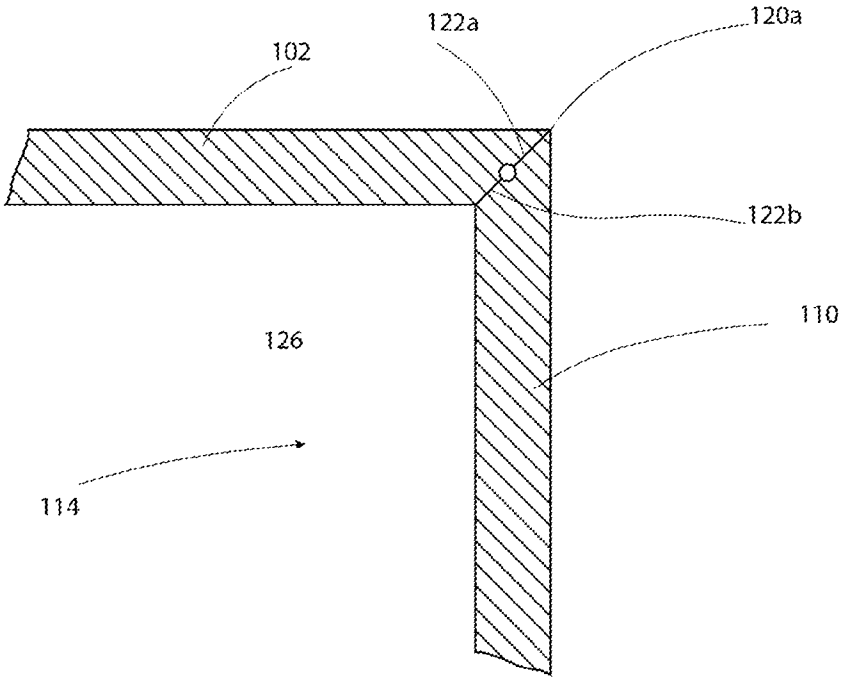
FIG. 20 is an enlarged cross-sectional view of mating surfaces of two living hinge panels of the container.

FIG. 20 is an enlarged cross-sectional view of two mating surfaces 122*a*, 122*b* of two living hinge panels, e.g., the top panel 102 and the rear panel 110 of the container 100. As illustrated in FIG. 20, the mating surfaces 122*a*, 122*b* are beveled to enhance the liquid- and/or air-tightness of container 100 in its assembly configuration. It should be appreciated, however, that the mating surfaces 122*a*, 122*b* may be at right angles to each other. Additionally, the mating surfaces 122*a*, 122*b* may include seal(s) 126, e.g., O-rings, lip seals, etc., for enhance the liquid- and/or air-tightness of container 100 in its assembled configuration.

Figure 21A:
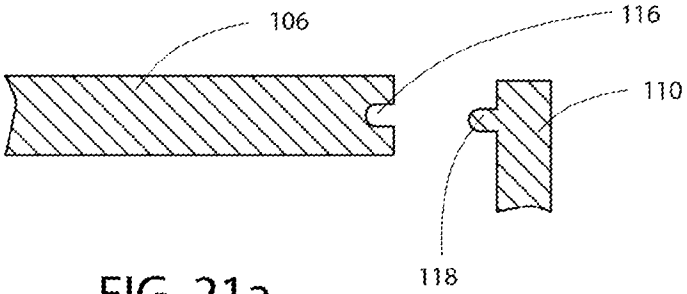
FIGS. 21*a* and 21*b* are enlarged cross-sectional views of mating surfaces of two panels of the container having a detachable latch mechanism.
Figure 21B:
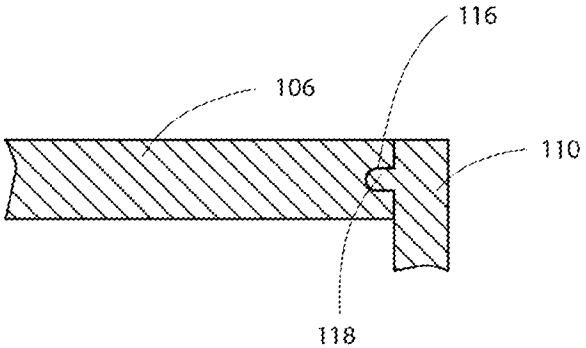

FIGS. 21*a* and 21*b* are enlarged cross-sectional views of two mating surfaces of two panels, e.g., rear panel 110 and side panel 106, that include detachable latch mechanism. FIG. 21*a* illustrates the detachable latch mechanism in its disengaged configuration, in which the protrusion 118 is not engaged with the groove 116, and FIG. 21*b* illustrates the detachable latch mechanism in its engaged configuration, in which the protrusion 118 is inserted into and received by the groove 116.

It should be appreciated that substantially is used in certain instances herein to refer to engineering tolerances and may indicate a certain deviation, e.g., 10%, 5%, 2%, 1%, 0.5%, 0.1%, etc.

LIST OF REFERENCE CHARACTERS

100 Container
102 Top Panel
104 Bottom Panel
106 First Side Panel
108 Second Side Panel
110 Rear Side Panel
112 Front Side Panel
114 Interior
116 Groove
118 Protrusion
120*a* Living Hinge/Integral Hinge
120*b* Living Hinge/Integral Hinge
120*c* Living Hinge/Integral Hinge
120*d* Living Hinge/Integral Hinge
120*e* Living Hinge/Integral Hinge
122*a* Mating Surface
122*b* Mating Surface
124 Indentation
126 Seal
L Length
W Width
H Height

What is claimed is:

1. A collapsible, lid-attached, food-safe storage container, comprising:

a rectangular planar bottom panel having first and second long sides having a length and first and second short sides having a width;

a rectangular planar top panel having first and second long sides having substantially the same length as the long sides of the bottom panel and first and second short sides having substantially the same width as the short sides of the bottom panel;

a rectangular planar rear panel having first and second long sides having substantially the same length as the long sides of the bottom panel and first and second short sides having substantially the same width as the short sides of the bottom panel;

a rectangular planar front panel having first and second long sides having substantially the same length as the long sides of the bottom panel and first and second short sides having substantially the same width as short sides of the bottom panel;

a first square planar side panel having four sides having substantially the same length as the short sides of the bottom panel; and a second square planar side panel having four sides having substantially the same length as the short sides of the bottom panel;

wherein the second long side of the top panel is integrally connected to the first long side of the rear panel by a first living hinge, the second long side of the rear panel is integrally connected to the first long side of the bottom panel by a second living hinge, the second long side of the bottom panel is integrally connected to the first long side of the front panel by a third living hinge, the first short side of the bottom panel is integrally connected to a first side of the first side panel by a fourth living hinge, and the second short side of the bottom panel is integrally connected to a first side of the second side panel by a fifth living hinge;

wherein the container is selectively collapsible between an assembled configuration and a collapsed configuration;

wherein, in the assembled configuration, the container is arranged as a rectangular cuboid having a fluid- and/or air-tight hollow interior space delimited by the front panel arranged opposite and facing the rear panel, the first side panel arranged opposite and facing the second side panel, and the top panel arranged opposite and facing the bottom panel, the first short side of the rear panel secured to a third side of the first side panel by a first detachable latch mechanism, the second short side of the rear panel secured to a third side of the second side panel by a second detachable latch mechanism, the first short side of the front panel secured to a fourth side of the first side panel, opposite the third side of the first side panel, by a third detachable latch mechanism, the second short side of the front panel secured to a fourth side of the second side panel, opposite the third side of the second side panel, by a fourth detachable latch mechanism, the first long side of the top panel secured to the second long side of the front panel, opposite the first long side of the front panel, by a fifth detachable latch mechanism;

wherein, in the assembled configuration, the top panel is pivotable about the first living hinge to selectively open and close the container to access the interior space;

wherein, in the assembled configuration, each panel has a respective first face facing the hollow interior space and a respective second face facing an exterior of the container;

wherein, in the collapsed configuration, the panels are stacked, the second face of the top panel arranged in abutting opposition to the second face of the rear panel, the first face of the rear panel arranged in abutting opposition to the first face of the bottom panel, the second face of each side panel arranged in abutting opposition to the second face of the bottom panel, the second face of the front panel arranged in abutting opposition to the first face of each side panel;

wherein the length of the bottom panel is at least twice the length of the side panels; and wherein the container is formed of a food-safe material.

2. The container according to claim 1, wherein the material includes a food-grade plastic.

3. The container according to claim 1, wherein the material includes high-density polyethylene (HDPE plastic), low-density polyethylene (LDPE plastic), polyethylene terephthalate (PET/PETE), food-grade polypropylene (PP), polycarbonate (PC), acrylic, and/or nylon.

4. The container according to claim 1, wherein the material includes a biodegradable and/or recyclable material.

5. The container according to claim 1, wherein the material is translucent.

6. The container according to claim 1, wherein the material is colorless.

7. The container according to claim 1, wherein the material is colored and/or tinted.

8. The container according to claim 1, wherein each latch mechanism includes an elongated protrusion arranged on a first mating surface of a first one of the panels that is insertable into a corresponding elongated groove arranged on a second mating surface of a second one of the panels.

9. The container according to claim 8, wherein the elongated protrusion extends substantially along an entire length of the first mating surface, and the elongated groove extends substantially along an entire length of the second mating surface.

10. The container according to claim 8, wherein the protrusion and the groove form an interference fit.

11. The container according to claim 1, wherein a front edge of the top panel includes an elongated groove or indentation arranged as an elongated finger pull.

12. The container according to claim 11, wherein the groove or indentation extends substantially along the entire length of the front edge of the top panel.

13. The container according to claim 1, wherein each mating surface of each of the panels is beveled.

14. The container according to claim 1, wherein each mating surface of at least one pair of adjacent panels is beveled.

15. The container according to claim 1, wherein each mating surface of each of the panels is orthogonal.

16. The container according to claim 1, wherein each mating surface of at least one pair of adjacent panels is orthogonal.

17. The container according to claim 1, wherein each mating surface at each living hinge is beveled, and each mating surface at each latching mechanism is orthogonal.

18. The container according to claim 1, wherein each pair of mating surfaces of the panels includes a seal.

19. The container according to claim 18, wherein the seal includes an O-ring and/or a lip seal.

20. The container according to claim 1, wherein the material includes a dishwasher-safe material.

21. The container according to claim 1, wherein the material includes a microwave-safe material.

22. The container according to claim 1, wherein a thickness of the top panel, the bottom panel, the first and second side panels, the front panel, and the rear panel are substantially equal.

* * * * *